US005409246A

United States Patent [19]

Ali

[11] Patent Number: 5,409,246

[45] Date of Patent: Apr. 25, 1995

[54] TETHERED BABY WALKER

[76] Inventor: Abdulkadir H. Ali, 1301 S. Taylor #22, Arlington, Va. 22204

[21] Appl. No.: 91,188

[22] Filed: Jul. 14, 1993

[51] Int. Cl.[6] ..... A47D 13/04

[52] U.S. Cl. ..... 280/87.051; 297/274; 403/398; 403/117; 472/15

[58] Field of Search ..... 280/87.051, 87.041, 280/87.05; 297/5, 137, 274, 275; 403/399, 398, 117, 97, 109; 472/15

[56] References Cited

U.S. PATENT DOCUMENTS

| | | | |
|---|---|---|---|
| 68,637 | 9/1867 | Maso | 297/274 |
| D. 119,382 | 12/1939 | De Puy | D12/130 |
| 671,058 | 4/1901 | Resetar | 472/15 |
| 822,329 | 6/1906 | Wilcox | 297/274 |
| 903,731 | 11/1908 | Kull | 297/274 X |
| 1,290,987 | 1/1919 | Haugen | 280/87.051 |
| 1,297,018 | 3/1919 | Scott | 472/15 |
| 1,297,800 | 3/1919 | Cranford | 472/15 |
| 1,313,330 | 8/1919 | Pocock | 297/137 |
| 1,920,130 | 7/1933 | Pease et al. | 403/399 |
| 2,352,450 | 6/1944 | Reinholz | 472/15 |
| 2,499,164 | 2/1950 | Richardson | 297/274 X |
| 2,551,267 | 5/1951 | Hegewald | 297/274 X |
| 3,721,437 | 3/1973 | Skaricic | 482/68 |
| 3,730,587 | 5/1973 | Bloxham et al. | 297/274 |

*Primary Examiner*—Margaret A. Focarino
*Assistant Examiner*—F. Zeender
*Attorney, Agent, or Firm*—Wigman, Cohen, Leitner & Myers

[57] ABSTRACT

A baby walker includes a tethering connector to constrain the walker to travel within a path defined by an articulated, telescoping boom, thereby restraining the baby to a range of travel within a predetermined zone of safety. The boom, which is rotatably affixed to a portable weighted base, is selectively angularly and radially limited in its travel relative to the interface of the boom and its point of attachment to the body of the walker. The tethering connector is also retrofittable to untethered baby walkers of the prior art.

10 Claims, 2 Drawing Sheets

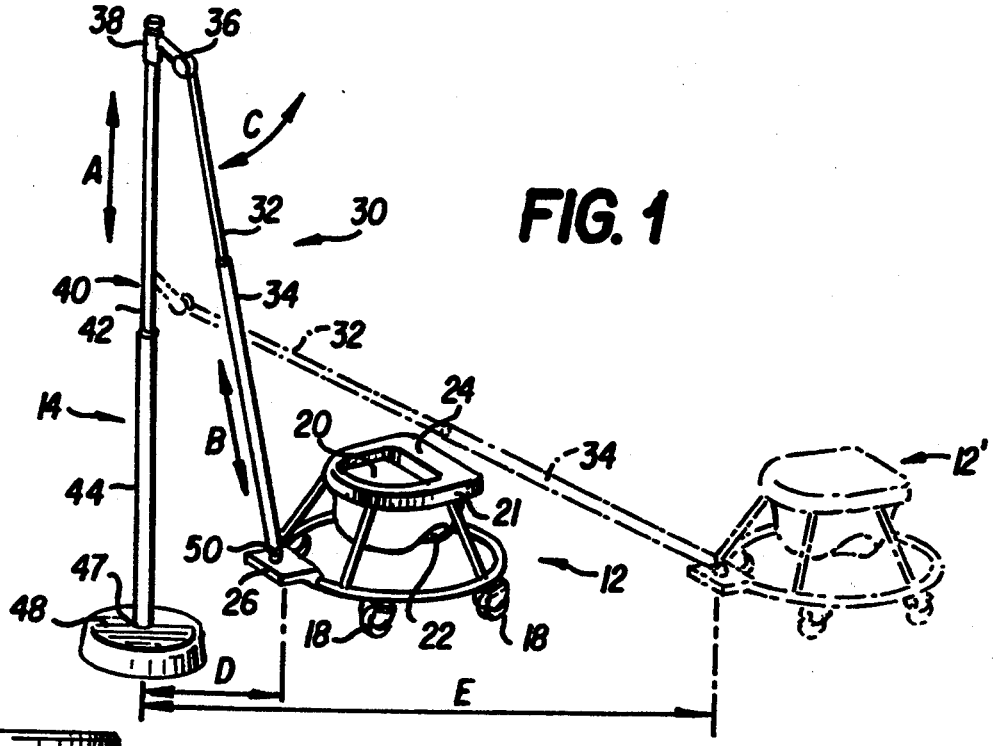
FIG. 1
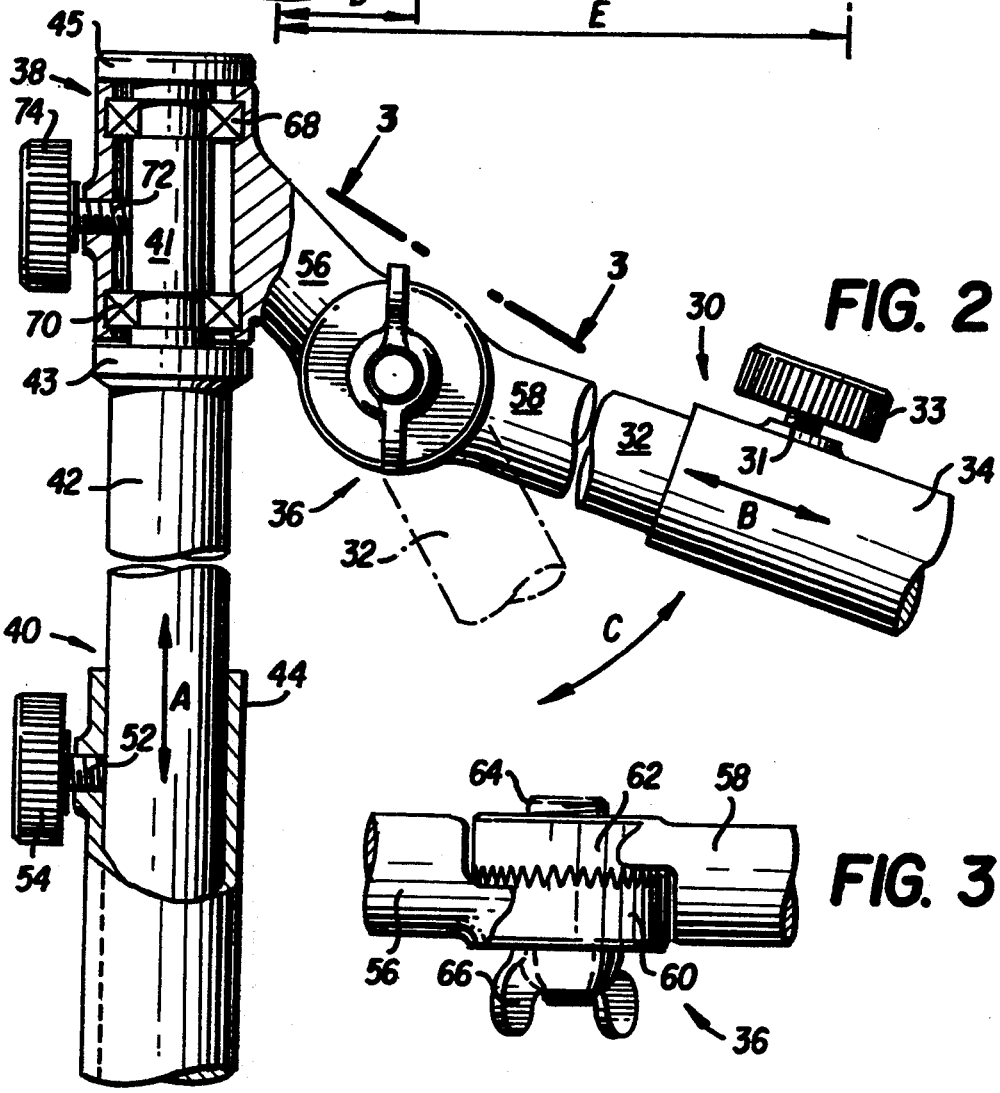
FIG. 2
FIG. 3

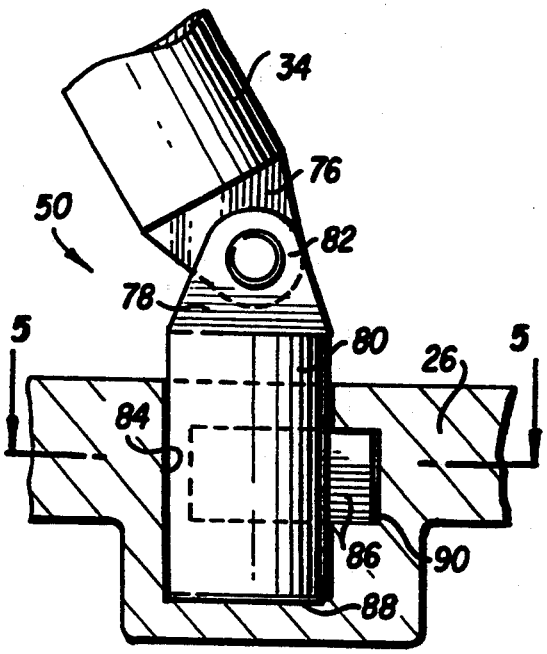
FIG. 4
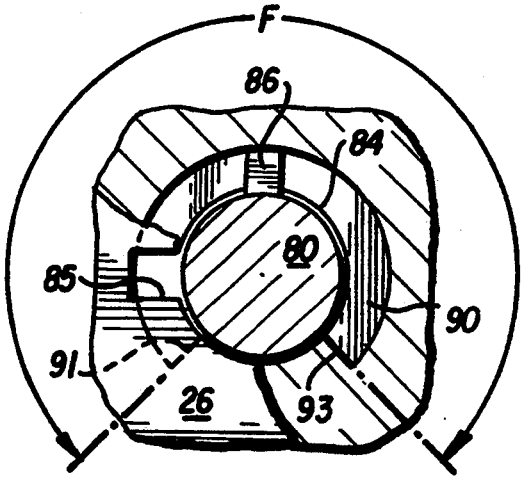
FIG. 5
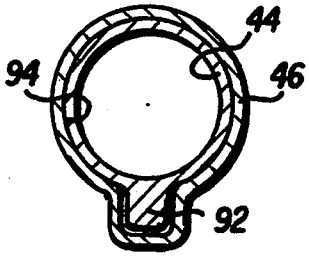
FIG. 7
FIG. 6
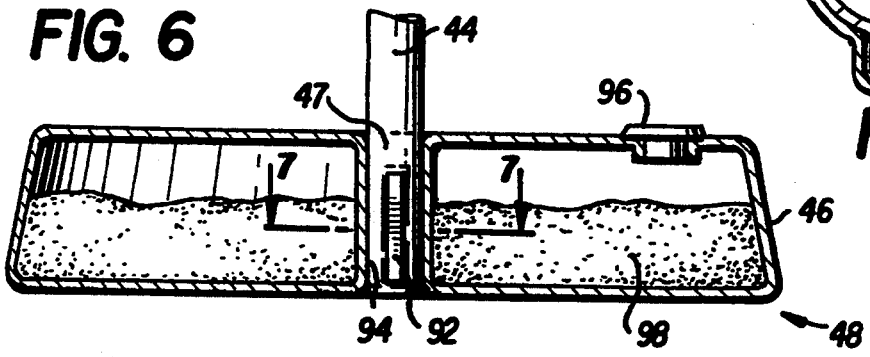
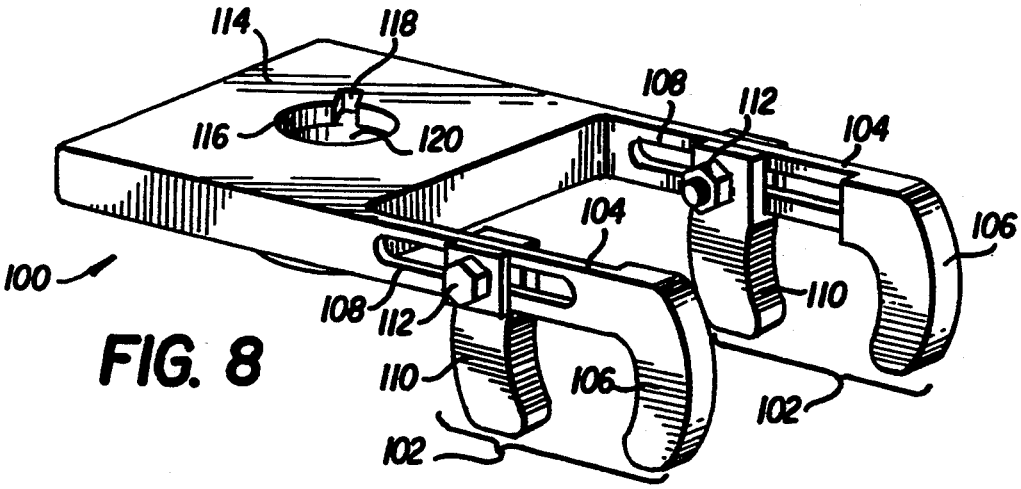
FIG. 8

TETHERED BABY WALKER

FIELD OF THE INVENTION

The present invention relates to baby walkers, and more particularly to a tethered baby walker which is adapted to be constrained to a preselected range of travel, and apparatus retrofittable to untethered baby walkers of the prior art for restricting a range of travel thereof.

BACKGROUND OF THE INVENTION

Baby walkers are widely used for accelerating the development of walking skills in babies and young children. In general, a baby walker includes a wheeled or castered frame or chassis fitted with a seat suspended or affixed thereto. The seat is typically oriented in a centered position relative to the wheels or casters to maximize the stability of the occupied walker, and includes openings through which the baby's legs are extended to enable foot contact with the floor and propulsion of the walker. Such baby walkers often include a partial body structure having tray-like surfaces extending to the front and around the sides and back of the seat to provide sufficient space and range to accommodate the baby's feeding utensils, toys, and the like.

In use, it has been observed that some babies can propel such walkers at unexpectedly rapid speeds in an uncontrolled manner away from a relatively secure environment and toward staircases, exposed structural elements, and other potentially hazardous surroundings or objects. Based on a strong concern surrounding this issue of safety, at least one Western country has outlawed the use of such untethered baby walkers as a result of numerous incidents which have resulted in severe injury and even death to some baby walker occupants.

Heretofore, a tethered baby walker which enables a relatively broad and adjustable range of travel has not been successfully achieved. For example, a tethered baby walker disclosed in U.S. Design Pat. No. D119,382 provides a baby walker which is limited to travel about a fulcrum at a fixed radius defined by the length of a flexible tether, such as a rope. Also, the walker is free to rotate completely about the fulcrum without any angular limitation, thereby limiting its effective use in smaller spaces a part of which may contain hazardous regions.

Another baby walker disclosed in U.S. Pat. No. 1,297,800 discloses a pole-type base permanently affixed to a floor and ceiling of the room in which the walker is to be used. A support arm extends horizontally from the upper portion of the pole. A basket in which the baby is supported is suspended from a coil spring which is affixed to and translatable along the length of the support arm. Mobility of the baby when secured within the basket is limited to the extent of the length of the support arm, in addition to any limited extension of the coil spring. One problem to this walker is that a relatively permanent installation is required, thereby eliminating desired portability and use at another location. Another problem is uncontrolled recoil of the spring after extension. This apparatus also shares with the previously described apparatus of the prior art the problem of an absence of any provision for limiting angular excursions of the walker as may be required by the constraints and hazards of a particular environment.

Yet another walker device, disclosed in U.S. Pat. No. 3,721,437, provides a walking trainer affixed to a portable vertical frame member. This walking trainer includes a castered frame having a horizontal frame member to which a harness is affixed. Although this walker is relatively portable by virtue of its free-standing castered frame, such apparatus is not only relatively large and ungainly thereby making it impractical for use in all but relatively large spaces, but also does not solve the safety issue of preventing uncontrolled access to potentially dangerous locations such as the top landings of staircases and the like.

Yet another problem with baby walkers of the prior art is the relatively large number of such units in current use which have no tethering or other restraint apparatus, thereby rendering them unsafe or even unlawful and imposing a large financial burden related to the abandonment and replacement of those obsolete units with walkers meeting new legal guidelines.

SUMMARY OF THE INVENTION

In view of the foregoing limitations and shortcomings of the prior art devices, as well as other disadvantages not specifically mentioned above, it should be apparent that there still exists a need in the art for a tethered baby walker which enables the baby to gain a desired amount of exercise and to explore its environment, but also to provide means for limiting travel of the walker to a predetermined range of travel, thereby preventing uncontrolled excursions into the vicinity of known safety hazards.

It is therefore an object of the present invention to provide a tethered baby walker which is readily and easily adjusted to a predetermined range of travel, and which is readily and easily adjusted to accommodate the dimensional confines of a particular space which is free of known safety hazards.

It is another object of the present invention to provide a tethered baby walker which is relatively portable for use in any desired location without regard to any structural requirements other than a relatively smooth surface for enabling wheeled or castered movement of the walker.

It is another object of the present invention to provide a tethering apparatus readily and easily retrofittable to baby walkers of the prior art.

The present invention provides a baby walker having a tethering connector to constrain the walker to travel within a path defined by an articulated, telescoping boom, thereby restraining the baby to a range of travel within a predetermined zone of safety. The boom is affixed at one end to a vertically adjustable post installed in a portable weighted base. Adjustment means are provided at the boom connection and along the length of the boom to enable boom length adjustment and angular displacement in the vertical plane. The opposite end of the boom is affixed to the body of the baby walker with a swivel connection. Selective adjustment of the vertical post and length and angular adjustment of the boom determines the outer radius of travel of the baby walker relative to the weighted base. The post end of the boom is also angularly adjustable to establish a predetermined range of rotation of the boom about the post to fully circumscribe the maximum range and extent of travel of the baby walker. The tethering connector is also retrofittable to untethered baby walkers by an adjustable clamping portion affixed to the boom for attachment to those walkers of the prior art.

The tethered baby walker and retrofittable tethering connector are readily disassembled as required for ease of transport to a selected location.

With the foregoing and other objects, advantages and features of the present invention that will become hereinafter apparent, the nature of the invention may be more clearly understood by reference to the following detailed description of the invention, the appended claims, and to the several views illustrated in the attached drawings.

BRIEF DESCRIPTION OF THE DRAWINGS

FIG. 1 is a perspective view of a tethered baby walker showing an exemplary range of adjustment of the vertical post and boom relative to the weighted base in which the vertical post is removably installed;

FIG. 2 is a fragmentary partial elevational view, partly in cross-section, of the adjustable connections of the vertical post and the boom, and of the boom about the vertical post;

FIG. 3 is a fragmentary top plan view of the angularly adjustable connection of the boom;

FIG. 4 is a fragmentary elevational view, partly in cross-section, of the swivel connection of the walker-end of the boom and the socket in the walker body in which that boom end is received;

FIG. 5 is a fragmentary view, partly in cross-section, taken along line 5—5 of FIG. 4, of the connection of the walker-end of the boom with the socket in which it is received;

FIG. 6 is an elevational view, in cross-section, of the weighted base of the present invention, showing the bottom end of the vertical post mounted therein;

FIG. 7 is a cross sectional view, taken along line 7—7 of FIG. 6, showing the fitting connection of the vertical post within the weighted base; and FIG. 8 is a perspective view of a retrofittable tethering connector of the present invention, showing a plurality of clamps for affixation to a frame or body of a prior art untethered baby walker, and a socket portion for receiving the free end of the boom.

DETAILED DESCRIPTION OF THE INVENTION

Referring now in detail to the drawings wherein like parts are designated by like reference numerals throughout, there is illustrated in FIG. 1 a tethered baby walker 10 comprised of a wheeled walker 12 and tethering apparatus 14. The walker 12 is comprised of a frame or chassis 16 constructed of a sturdy material such as metal tubing or the like. A plurality of wheels or casters 18 are affixed to the lower periphery of the frame 16 to enable multidirectional rolling mobility of the walker 12. A seat 20 is suspended from or affixed to an upper portion of the frame 16, and is oriented in a centered position relative to the wheels or casters to maximize the stability of the occupied walker 12. The seat 20 includes a pair of openings 22 (only one shown) through which the baby's legs are extended to enable foot contact with the floor and propulsion of the walker. The walker 12 is also provided with an upper body structure 21 having a tray-like top surface 24 extending to the front and around the sides and back of the structure 21 to provide sufficient space and range to accommodate the baby's feeding utensils, toys, and the like. A connector plate 26 for removably connecting the tethering apparatus 14 to the walker 12 is rigidly affixed to the walker frame 16 at a bottom rear portion thereof.

The tethering apparatus 14 includes an articulated and extendable boom 30. The boom 30 includes an upper boom portion 32, a lower boom portion 34 extending in telescoping manner therefrom, and an articulated knuckle portion 36 extending upwardly from the upper boom portion 32. The knuckle portion 36 extends to a sleeve portion 38 rotatably mounted to the upper end of a vertically adjustable post 40. The vertical post 40 includes an upper post portion 42, and a lower post portion 44 extending in telescoping fashion therefrom having a lower portion 47 adapted to be securely received in a portable weighted base 48. The lower boom portion 34 is flexibly affixed to the connector plate 26 by an articulated joint 50, to be further described below.

In use, the tethered baby walker 10 is adjusted to accommodate the dimensional confines of a particular space which is free of known safety hazards by manipulating the height of the vertical post 40 in the direction of arrow A, the length of the boom 30 in the direction of arrow B, and the angle of the boom 30 along the arc of arrow C. An exemplary range of configurations of the apparatus is shown in FIG. 1. For close quarters applications the boom 30 is articulated radially inwardly along the arc of arrow C toward the vertical post 40. The height of the vertical post 40 is concurrently adjusted with the extension of the boom 30 in the directions A and B, respectively, to enable the walker wheels 18 to remain in firm contact with the floor. In this position the articulated joint 50 is spaced from the vertical post 40 by a radial distance indicated by arrow D.

When a greater range of motion of the walker 12 is desired, the boom 30 is extended outwardly in the direction B to a radial distance indicated by arrow E. Concurrently, the height of the vertical post 40 and the angle of articulation of the boom 30 are adjusted along arrows A and C, respectively to maintain the walker 12 in rolling contact with the floor to the extended walker position 12' shown in phantom.

More particularly, and with reference to FIG. 2, the upper post portion 42 is coaxially aligned in telescoping relation with the lower post portion 44. A friction lock comprised of a threaded bolt 52 terminated with a knurled handle 54 is threaded through a threaded bore in the wall of the lower post portion 44 so as to engage the outer periphery of the upper post portion 42 with a friction grip. Vertical telescoping adjustment of the post portions 42, 44 is achieved by untightening the bolt 52 to enable sliding telescoping adjustment of the post portions 42, 44 as required to reach a desired vertical extension, followed by tightening of the bolt 52 to secure the post portions 42, 44 at that extension. Extensible adjustment of the upper boom portion 32 which is coaxially assembled to the lower boom portion 34 is achieved in a similar manner with a threaded bolt 31 and knurled handle 33.

The upper boom portion 32 is angularly articulated in a vertical plane by means of the articulated knuckle portion 36, more fully shown in FIG. 3. The knuckle portion 36 comprises an upper knuckle extension 56 fixed to the upper post portion 42 and a lower knuckle extension 58 integrally connected to the upper boom portion 32. A toothed coupling ring 60 is formed at the end of upper knuckle extension 56, and another complementary toothed coupling ring 62 is formed at the end of lower knuckle extension 58. The knuckle portion 36 is locked at a desired angle by bringing the complementary teeth of the coupling rings 60, 62 into interengaging relationship, and then inserting a threaded bolt 64 through bores in the centers of the coupling rings 60, 62 and securing the rings in position with a wing nut 66 threadably affixed to the end of the bolt 64 as best seen in FIG. 3.

Referring again to FIG. 2, the uppermost end of the boom 30 comprising upper knuckle extension 56 extends to and terminates at a sleeve portion 38. More particularly, the sleeve portion 38 is coaxially and rotatably mounted to the upper post portion 42 of the vertical post 40. An upper anti-friction bearing 68 and a lower anti-friction bearing 70 rotatably mount the sleeve portion 38 to the vertical post 40 and enable complete 360° rotation of the boom 30 may be locked into a fixed motion of the boom 30 about the vertical post 40. Optionally, the boom 30 may be locked into a fixed position by engaging a friction lock therewith in the manner previously described, such friction lock including a threaded bolt 72 terminated with a knurled handle 74 projecting through the wall of the sleeve portion 38 with a threaded connection to engage periphery of a reduced diameter section 41 of the upper post portion 42 with a friction fit. The rotatable sleeve portion 38 is axially retained by an enlarged diameter portion 43 of the upper post portion 42 and a cap 45 secured to the upper end of post portion 42.

With reference now to FIG. 4, the lower boom portion 34 is universally affixed to the connector plate 26 by an articulated joint 50. More particularly, the lower boom portion 34 includes a tapered end section 76 which is pivotably connected to another tapered end section 78 of a truncated vertical post section 80 by a pivot connection 82. The post section 80 is vertically aligned with and received within a complementary-shaped blind bore 84 in the top surface of the connector plate 26 affixed to the rear portion of the walker 12. A tang 86 provided on the outer diameter of the post section bore 80 is guided in a circuferential recess 90 undercut in the wall of 84 to securely retain the assembly while allowing limited angular rotation, as is more clearly shown in FIG. 5. The recess 90 extends through an arc represented by arrow F of about 270 degrees about the rotational axis of the post 80. The range of rotation may be greater or less than 270 degrees as desired. A keyway 85 is formed in the upper surface of connector plate 26 and intersects recess 90 so as to receive tang 86 of post 80 as it is inserted in bore 84. Angular rotation of post 80 is limited by abutment of the tang 86 with the end surfaces 91, 93 of the recess 90.

Referring now to FIG. 6, the lower post portion 44 of the vertical post 40 is securely received in a portable hollow weighted base 48 made of a hollow plastic shell 46, for example. The lower post portion 44 includes a radially outwardly extending tang 92 and is configured to be received within a complementary shaped central recess 94 of the weighted base 48 to prevent rotation therebetween with a locking relationship, as is more clearly shown in FIG. 7. Referring again to FIG. 6, the weighted base 48 includes a filling port 96 through which a quantity of sand or water 98 is added. A sufficient quantity of sand or water 98 is provided to restrain the vertical post 40 against potential displacement forces caused by the various excursions of the walker 12.

With reference now to FIG. 8, the present invention also includes a tethering connector 100 which is retrofittable to untethered baby walkers of the prior art. This tethering connector 100 includes two clamping portions 102 for gripping a frame portion or a body portion of such prior art walker (not shown). Each clamping portion 102 includes a laterally extending arm portion 104 terminating with a hook portion 106. Each arm portion 104 also includes a laterally extending slot 108 along which a curved finger portion 110 is slidably affixed with a threaded releasable bolt connection 112. The slots 108 are in parallel alignment and extend a sufficient distance to enable a broad range of adjustment of the finger portions 110 necessary to accommodate varying frame and body thicknesses of the prior art walkers to which the clamping portions 102 will be attached. The confronting contact portions of the hook portions 106 and finger portions 110 are knurled or fluted to insure a secured connection in the installed condition. The tethering connector 100 also includes a boom receiving portion 114 for receiving the truncated vertical post section 80 of the boom 30 in the manner previously described in connection with FIGS. 4 and 5. The post section 80 is vertically aligned with and received within a complementary shaped blind bore 116 in the top surface of the boom receiving portion 114 so that the tang 86 provided on the outer periphery of the post section 80 extends through a keyway 118 into an undercut recess 120 similar to the recess 90 also shown and described in connection with FIGS. 4 and 5. According to this embodiment, the tethering connector 100 is readily adapted for use with the tethering apparatus 14 of the present invention, all of which is readily disassembled as required for ease of transport to a selected location or for use with a variety of untethered baby walkers of the prior art.

Although a preferred embodiment of the baby walker and retrofittable restraining apparatus therefore of the present invention has been described herein and fully illustrated by the drawing figures, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A tethered walker apparatus, comprising:

a walker frame;

a seat mounted to said frame and adapted to receive an occupant;

means mounted to the frame for rollably engaging a support surface;

a vertical post having a longitudinal axis; and means for adjustably and fixedly tethering said walker frame at a predetermined radial distance from the longitudinal axis of the vertical post, said means including a boom having a pair of telescoping boom portions and means for adjustably and fixedly retaining said boom portions at a selected extension;

wherein one of said boom portions includes an adjustably and fixedly locking knuckle about which the boom is pivotally articulatable in a plane coincident with a plane through the longitudinal axis of the vertical post.

2. The tethered walker apparatus as claimed in claim 1, wherein said locking knuckle includes a pair of interengaging toothed locking rings formed in one of said boom portions at an intermediate extent thereof and secured in a selected locked position with a releasable connector.

3. A tethered walker apparatus, comprising:

a walker frame:

a seat mounted to said frame and adapted to receive an occupant;

means mounted to said frame for rollably engaging a support surface;

a vertical post having a longitudinal axis;

means for adjustably and fixedly tethering said walker frame at a predetermined radial distance from the longitudinal axis of the vertical post, said means including a boom having a first end rotatably mounted to said vertical post; and a connector plate rigidly affixed to a rear frame portion of said walker frame;

wherein said boom includes a second end opposite the first boom end, said second end being pivotally connected to a truncated post portion adapted to be received in a complementary-shaped bore of said connector plate with a rotational fit therebetween.

4. The tethered walker apparatus as claimed in claim 3, further comprising a tang provided on an outer periphery of said truncated post portion, and a circumferential recess disposed in said connector plate for receiving and limiting said tang to a selected arcuate range of travel.

5. The tethered walker apparatus as claimed in claim 4, wherein said tang is limited to an arcuate range of travel of about 270 degrees about a longitudinal axis of the truncated post portion.

6. The tethered walker apparatus as claimed in claim 4, wherein said arcuate range of travel is selected to prevent rotation of said walker seat directly under said boom member.

7. The tethered walker apparatus as claimed in claim 3, wherein said first end of said boom is affixed to a sleeve portion rotatably mounted to said vertical post, said sleeve portion including means for adjustably and fixedly retaining said boom at a selected angular position relative to the longitudinal axis of the vertical post.

8. A tethering apparatus, comprising:

a vertical post having a longitudinal axis; and means for adjustably and fixedly tethering a free-ranging walker having a seat from which an occupant can propel said walker within a selected radial and circumferential range of travel relative to the longitudinal axis, said tethering means including:

a clamping portion for gripping a rigid structure of said walker, said clamping portion including a laterally extending arm portion terminating at a hook portion, and a finger portion slidably affixed along said arm portion to secure said clamping portion to said walker with a clamping fit therebetween, and a boom receiving portion; and boom means for engaging said boom receiving portion so as to secure said walker within said selected range of travel;

wherein said clamping portion includes two laterally extending arm portions each having a laterally extending slot in parallel alignment and a finger portion slidably affixed to each of said slots.

9. The tethering apparatus as claimed in claim 8, wherein said boom means has a first boom end thereof rotatably mounted to said vertical post and a second boom end opposite the first boom end being universally affixed to said boom receiving portion by an articulated joint.

10. The tethering apparatus as claimed in claim 9, wherein said second boom end includes a first portion being pivotally connected to a second portion of a truncated post section, said truncated post section being adapted to be received in a complimentary-shaped bore of said boom receiving portion with a rotational fit therebetween, and a tang provided on the outer periphery of said truncated post portion adapted to be received within a circumferential recess disposed in said boom receiving portion for receiving and limiting said tang to a selected circumferential range of travel.

* * * * *